United States Patent [19]

Longenecker

[11] 4,232,462

[45] Nov. 11, 1980

[54] CALENDARS

[76] Inventor: Lineaus W. Longenecker, R.D. 5, Manheim, Pa. 17545

[21] Appl. No.: 747,156

[22] Filed: Dec. 3, 1976

Related U.S. Application Data

[62] Division of Ser. No. 614,817, Sep. 18, 1975, Pat. No. 4,055,011.

[51] Int. Cl.[3] ..... G09D 3/04

[52] U.S. Cl. ..... 40/119; 40/160; 40/615

[58] Field of Search ..... 40/119, 107, 110, 118, 40/116, 117, 160, 135; 46/35-37; 283/2-4; 35/13, 53, 26

[56] References Cited

U.S. PATENT DOCUMENTS 2,149,779 3/1939 Kroner ..... 40/135 X

FOREIGN PATENT DOCUMENTS 1531088 5/1968 France ..... 40/119

OTHER PUBLICATIONS

The World Book Encyclopedia, 1974, vol. 9, pp. 378-379.

Structure, 1941, Gen. Electric Co.

*Primary Examiner*—John F. Pitrelli

*Attorney, Agent, or Firm*—Beveridge, DeGrandi, Kline & Lunsford

[57] ABSTRACT

A calendar has transparent overlay pages which carry opaque calendar data areas and opaque picture portions which are superimposed on an underlying picture, with the opaque picture portions depicting the underlying obscured portions at a different season of the year.

5 Claims, 5 Drawing Figures

CALENDARS

This is a division of application Ser. No 614,817 filed Sept. 18, 1975, now U.S. Pat. No. 4,055,011.

BACKGROUND OF THE INVENTION

This invention relates to improved display devices provided with a pictorial representation which is changed by opaque picture portions in transparent overlay areas.

Pictorial calendars heretofore have been primarily of the type wherein a single picture is displayed throughout the year, or wherein a number of separate pages each bear their own complete picture. Unlike these previous calendars, one aspect of this invention is directed to a calendar wherein a single basic picture is displayed throughout the year, but certain portions thereof are changed during the course of the year, preferably to present an appearance corresponding to the time period represented by the uppermost calendar page.

There have been display devices which utilize transparent overlay sheets which bear picture portions representing snowcovered scenic elements, anatomical features or cutaway views of mechanical or physical objects. In some instances, these overlay sheets have borne different picture portions on their opposite sides which are material elements of objects depicted on opposite leaves of a book.

SUMMARY OF THE INVENTION

According to this invention, a calendar is formed of a base sheet and a plurality of overlay sheets. The base sheet is provided with a picture and the overlay sheets are provided with a transparent area and picture portions which are adapted to overlie portions of the picture on the base sheet, thus forming a composite picture including elements both from the base picture and the picture portions of the overlay sheets.

The transparent overlay sheets and possibly the base sheet carry conventional calendar data areas which may be arranged on a weekly, monthly or quarterly basis. These calendar data areas on the transparent overlay sheets are positioned where they will be in register with each other, so that the placement of one transparent overlay sheet over the face of the calendar will obscure any previously-visible calendar data areas, while at the same time changing certain portions of the composite picture displayed by the calendar.

For a more complete understanding of the invention, reference is made to the preferred embodiment thereof shown in the drawings and described in the following description.

DRAWINGS

Figure 5:
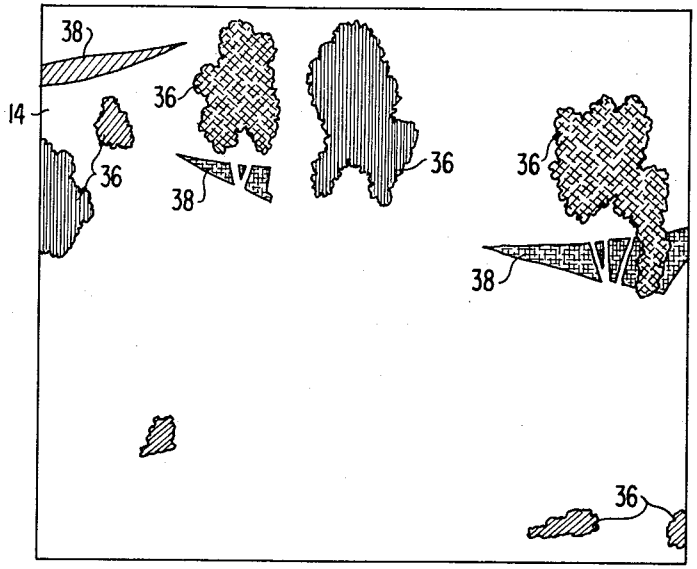
Figure 4:
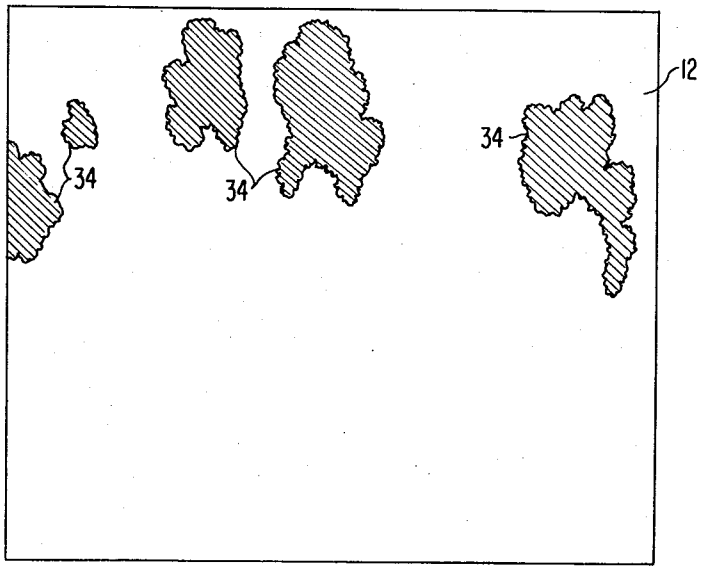

FIGS. 4 and 5, respectively, show the picture portions of the third and fourth calendar overlay sheets which correspond to the summer and fall seasons of the year.

BRIEF DESCRIPTION

Figure 1:
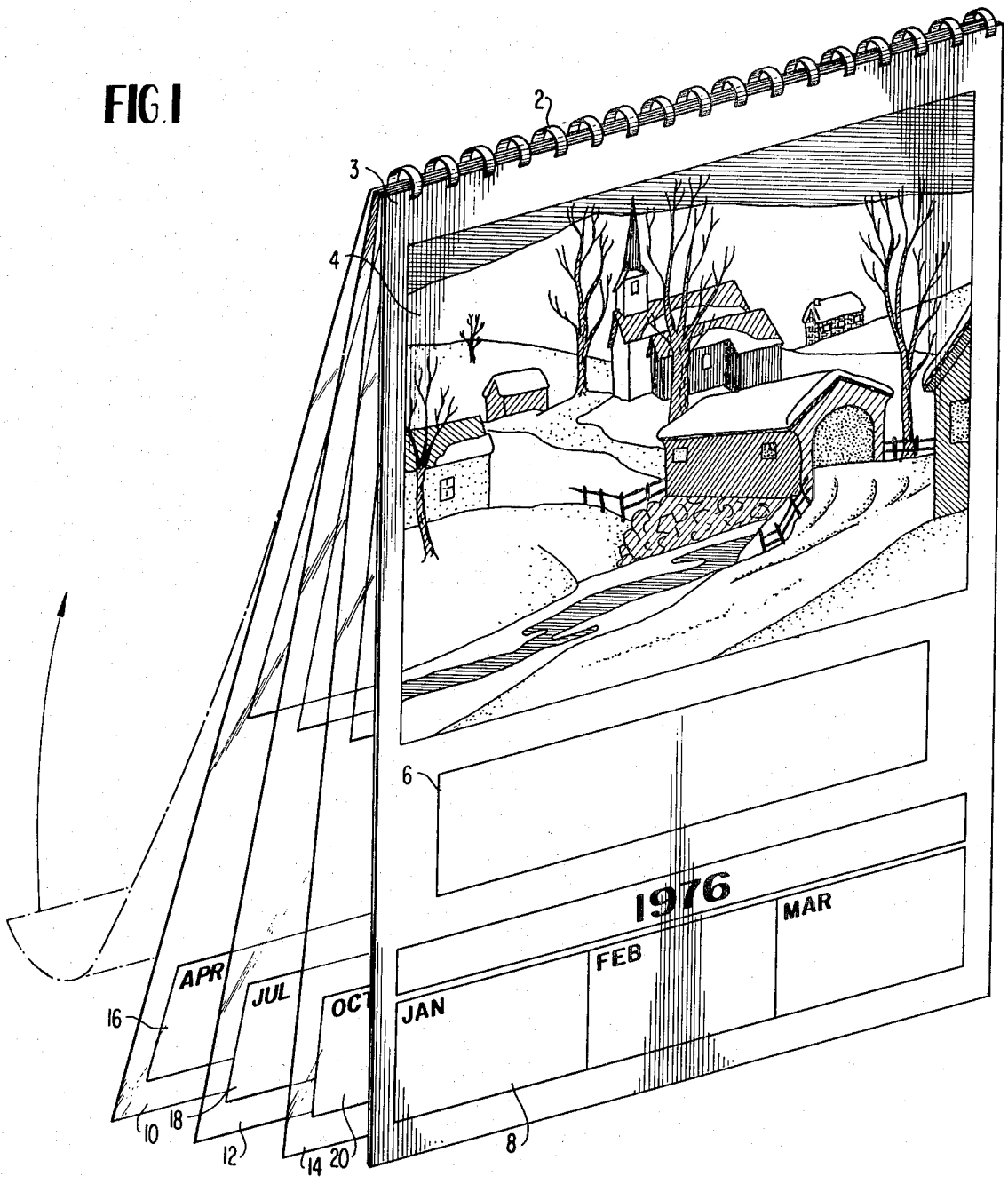
FIG. 1 is a perspective view of a calendar showing the base sheet and three transparent overlay sheets in their obscured position.

In FIG. 1, it will be seen that a calendar includes four sheets which are hingedly connected at their upper edge by a ring binder 2 or by folding, stapling or the like. The foremost sheet 3 is of cardboard or other semi-rigid material and is provided with a picture 4, an advertising-bearing area 6 and a calendar data area 8.

The illustrated picture 4 is a scenic view of a village landscape wherein the trees are barren of foliage and the ground and roofs of the building are covered with snow. This, of course, corresponds with the winter season represented in the calendar data area 8 which has calendar portions for the months of January, February and March. The days of the month are imprinted in the corresponding blocks, but they have been omitted for clarity of illustration.

The sheets 10, 12 and 14 are overlay sheets designed to be flipped forward to overlie the base sheet 3. They are provided with opaque calendar data areas 16, 18 and 20 which are positioned where they will register with and overlie any calendar data area therebeneath. Thus, as the overlay sheet 10 is placed in front of the base sheet 3, the calendar data area 16 for the months of April, May and June will obscure the calendar data area 8 for the months of January, February and March.

Figure 2:
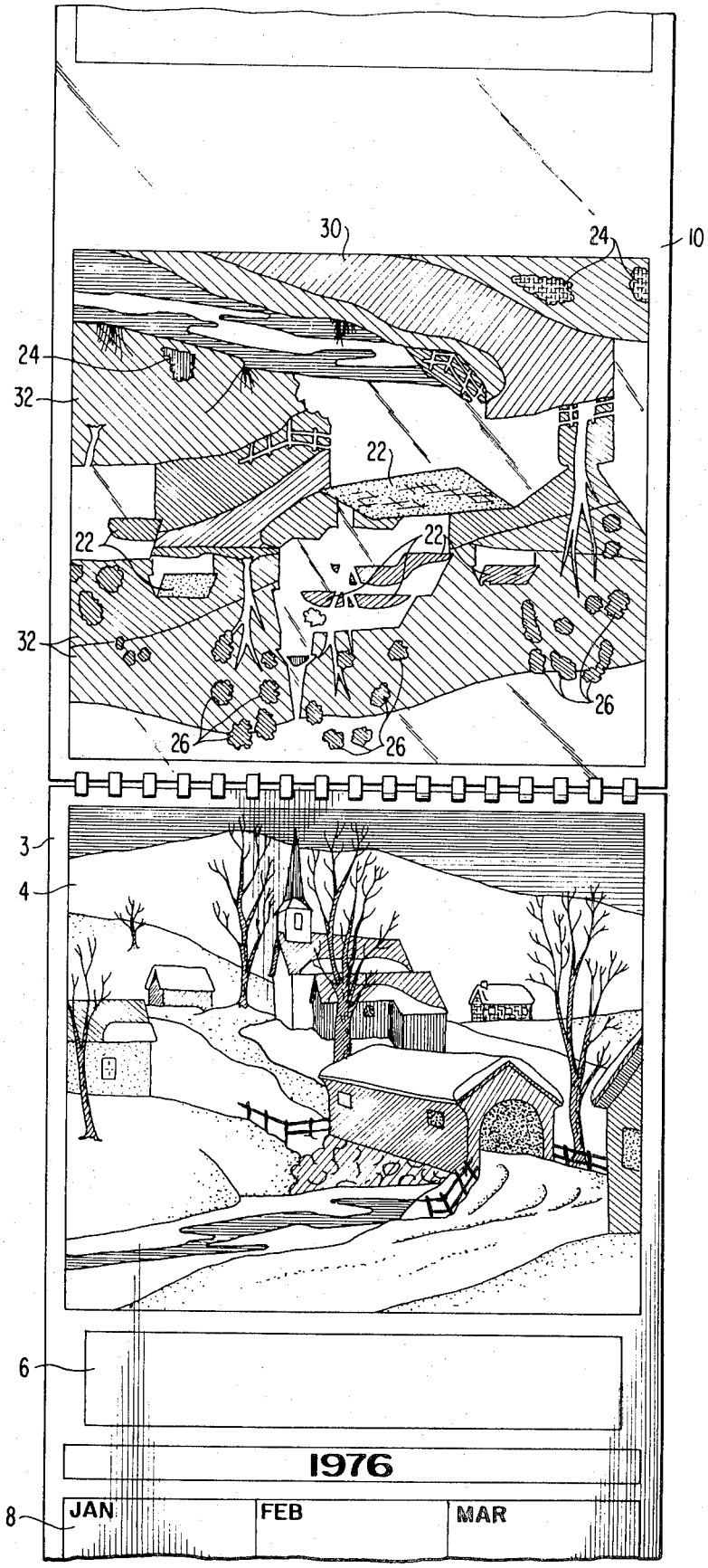
FIG. 2 shows the base sheet of the calendar of FIG. 1 and, in inverted form thereabove, the first overlay page which presents picture portions associated with the spring season of the year.

The overlay sheets 10, 12 and 14 are provided with transparent areas which carry picture portions which register with portions of the picture 4 on the base sheet 3. The content of these picture portions for the first overlay sheet 10 will be seen in FIG. 2 wherein roof segments 22 are provided to overlie the patches of snow seen in the picture 4, and spring foliage is added to the scene. The drawings are lined for color according to 37 CFR 3.61, indicating that brightly-colored flowered shubbery 24 has appeared on the scene, tufts of green foliage 26 appear at the tips of the tree branches. Roof picture portions 22, roadway picture portions 30 and field picture portions 32 are provided to obscure the previously-seen snow in the picture 4.

Figure 3:
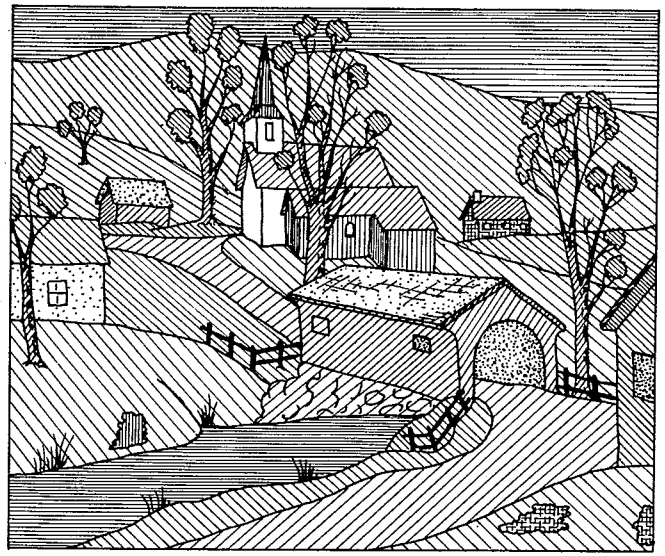
FIG. 3 shows the composite picture in the calendar of FIG. 1, formed by the first overlay sheet superimposed on the base picture.

FIG. 3 illustrates the appearance of the picture formed by the base picture 4 with the first overlay sheet 10 superimposed thereabove. Of course, when the composite picture appears in this form, the calendar data area will indicate the months of April, May and June, i.e. the months during which a landscape would have the appearance shown in the composite picture.

The transparent overlay 12 for the summer months of July, August and September is similar to FIG. 3, except that the trees have leafed out more fully, as will be seen from FIG. 4 which illustrates the enlarged green picture portions 34 added to the composite picture by this transparent overlay.

The fall season, typified by its colorful foliage, is associated with the third overlay sheet 14 which carries the calendar data areas for the months of October, November and December. As seen in FIG. 5, the picture portions 36 to be superimposed during this part of the calendar year include multicolored foliage, being indicated as brown, orange, yellow and red. Of course, many shades may be used. This scene also includes picture portions 38 which provide a change in color of the crops or grass growing in certain fields, making it more representative of this particular season of the year.

It has been observed that the use of multiple transparent overlay sheets will hang so as to provide a slight spacing between portions of adjacent sheets. This imparts a three-dimensional appearance to a landscape scene, making it very attractive both from the standpoint of the colors utilized and the general aesthetic appearance of the composite picture.

From the foregoing, it will be seen that the invention presents a unique and attractive calendar wherein a given picture changes its characteristics to correspond with the time of year indicated by the calendar data areas which are visible. Of course, the uppermost overlay sheet may be the one bearing the winter picture portions and the winter calendar data area, so that seasonal changes are effected by removing rather than by adding overlay sheets. The picture may differ from the one illustrated and may be of objects other than landscapes, for example a human figure, with the overlay picture portions carrying different garments which preferably but not essentially are associated with the time of year shown on the associated calendar data areas. The year may be broken into seasons other than those indicated, perhaps on a monthly or weekly basis which would require a substantially larger number of overlay sheets. The overlay sheets may be made of transparent sheet material or they may be made of paper or other opaque materials, provided with windows which receive transparent acetate sheets bearing the picture portions.

Therefore, it is emphasized that the invention is not limited only to the disclosed embodiment, but it is encompassing of all subject matter within the spirit of the claims which follow.

I claim:

1. A calendar, comprising, a base sheet having a picture thereon in the form of a landscape scene, said base sheet having thereon opaque calendar data areas which bear calendar data, an overlay sheet having a transparent area movable to overlie the picture on the base sheet, overlay picture portions in said transparent area which register with and obscure portions of said picture on said base sheet, said overlay picture portions depicting vegetation associated with the season of the calendar data area of the respective overlay sheet, opaque calendar data areas carried by said overlay sheet and located in register with corresponding said opaque calendar data areas; whereby the placement of a transparent overlay sheet over the calendar serves to add overlay picture portions to the picture, and to obscure a calendar data area therebeneath while presenting its own calendar data area.

2. The calendar of claim 1 wherein the base sheet and the overlay sheet are interconnected along one edge.

3. The calendar of claim 1 wherein the landscape scene on the base sheet includes snow picture portions depicting snow covered areas, and the overlay sheet includes opaque picture portions for registering with and overlying said snow picture portions to conceal the snow covered areas.

4. The calendar of claim 1 wherein the landscape scene on the base sheet includes tree picture portions depicting tree trunks and branches, said overlay picture portions including said vegetation depicted as foliage in registration with the tree branches.

5. The calendar of claim 4 wherein the landscape scene on the base sheet includes snow picture portions depicting snow covered areas, and the overlay sheet includes opaque picture portions for registering with and overlying said snow picture portions to conceal the snow covered areas.

* * * * *